US011401928B2

(12) United States Patent
Vrdoljak et al.

(10) Patent No.: US 11,401,928 B2
(45) Date of Patent: Aug. 2, 2022

(54) VARIABLE FLOW RATE MECHANICAL PUMP ASSEMBLY

(71) Applicant: SHARKNINJA OPERATING LLC, Needham, MA (US)

(72) Inventors: Ognjen Vrdoljak, Quebec (CA); John-Paul Perron, Brookline, MA (US); Dan Meyer, Boston, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/188,276

(22) Filed: Mar. 1, 2021

(65) Prior Publication Data

US 2021/0254615 A1 Aug. 19, 2021

Related U.S. Application Data

(63) Continuation of application No. 15/108,112, filed as application No. PCT/US2014/046689 on Jul. 15, 2014, now Pat. No. 10,932,644.

(Continued)

(51) Int. Cl.

| | |
|---|---|
| ***F04B 49/12*** | (2006.01) |
| ***F04B 9/04*** | (2006.01) |
| ***F04B 1/07*** | (2006.01) |
| ***A47L 13/22*** | (2006.01) |
| ***F04B 17/03*** | (2006.01) |

(Continued)

(52) U.S. Cl.

CPC ..... *F04B 49/12* (2013.01); *A47L 13/225* (2013.01); *F04B 1/07* (2013.01); *F04B 9/042* (2013.01); *F04B 9/047* (2013.01); *F04B 17/03* (2013.01); *F04B 53/14* (2013.01); *F04B 53/16* (2013.01); *A47L 11/03* (2013.01); *A47L 13/22* (2013.01)

(58) Field of Classification Search

CPC ..... A47L 13/22; A47L 13/225; A47L 11/03; F04B 1/07; F04B 9/042; F04B 9/047; F04B 17/03; F04B 49/12; F04B 53/14; F04B 53/12; F04B 53/16; F04B 9/06

USPC ..... 15/401, 410, 320; 401/1, 138, 270

See application file for complete search history.

(56) References Cited

U.S. PATENT DOCUMENTS

| | | | |
|---|---|---|---|
| 2,972,894 | A | 2/1961 | Bennett |
| 4,604,539 | A | 8/1986 | Bertram et al. |

(Continued)

FOREIGN PATENT DOCUMENTS

| | | |
|---|---|---|
| CN | 202184697 | 4/2012 |
| DE | 1209395 | 1/1966 |

(Continued)

OTHER PUBLICATIONS

International Preliminary Report on Patentability dated Jan. 28, 2016, received in corresponding Application No. PCT/US2014/046689, 7 pages.

(Continued)

*Primary Examiner* — Katina N. Henson

(74) *Attorney, Agent, or Firm* — Grossman Tucker Perreault & Pfleger, PLLC

(57) ABSTRACT

A mechanical pump includes a motor with an output shaft, a cam coupled to the output shaft for rotating the cam when the motor is energized, and a driver with spaced ledges engaging the cam and driven linearly by the rotating cam. The piston is driven by the driver. A cylinder receives the piston therein and includes an inlet section for drawing fluid into the cylinder and an outlet section for pumping fluid out of the cylinder as the piston reciprocates in the cylinder.

13 Claims, 18 Drawing Sheets

Related U.S. Application Data

(60) Provisional application No. 61/970,481, filed on Mar. 26, 2014, provisional application No. 61/847,319, filed on Jul. 17, 2013.

(51) Int. Cl.

| | |
|---|---|
| ***F04B 53/14*** | (2006.01) |
| ***F04B 53/16*** | (2006.01) |
| *A47L 11/03* | (2006.01) |

(56) References Cited

U.S. PATENT DOCUMENTS

| | | | |
|---|---|---|---|
| 4,702,674 | A | 10/1987 | Fontaine et al. |
| 2006/0110259 | A1 | 5/2006 | Puff et al. |
| 2012/0177505 | A1 | 7/2012 | Gerlach |
| 2013/0163968 | A1 | 6/2013 | Hsu |
| 2013/0167319 | A1 | 7/2013 | Tang |
| 2013/0294946 | A1 | 11/2013 | Su et al. |

FOREIGN PATENT DOCUMENTS

| | | |
|---|---|---|
| DE | 2446806 | 4/1976 |
| DE | 3419177 | 1/1985 |
| EP | 0433649 | 6/1991 |
| GB | 2497816 | 6/2013 |

OTHER PUBLICATIONS

PCT Search Report and Written Opinion dated Nov. 6, 2014, received in corresponding PCT Application No. PCT/US2014/046689, 12 pages.

Extended European Search Report dated Mar. 13, 2017, received in European Patent Application No. 14825635.7, 9 pages.

VARIABLE FLOW RATE MECHANICAL PUMP ASSEMBLY

RELATED APPLICATIONS

This application claims benefit of and priority to U.S. Provisional Application Ser. No. 61/970,481 filed Mar. 26, 2014 and to U.S. Provisional Application Ser. No. 61/847,319 filed Jul. 17, 2013, under 35 U.S.C. §§ 119, 120, 363, 365, and 37 C.F.R. § 1.55 and § 1.78, and both are incorporated herein by this reference.

FIELD OF THE INVENTION

The subject invention relates to pumps and, in one version, a pump for a steam appliance steam generator.

BACKGROUND OF THE INVENTION

Steam appliances (mops and the like) may include a liquid reservoir, a steam generator (boiler) and a pump between the liquid reservoir and the steam generator. If variable settings are present, the pump may be a variable rate pump controlled by an electronic circuit responsive to a switch setting. Most are DC powered pumps requiring voltage conversion circuitry.

Published patent application Nos. 2010/0287716; 2010/0236018; and 2006/0222348 describe different steam appliance pump subsystems and are incorporated herein by this reference. U.S. Pat. Nos. 3,139,829 and 2,968,963 show examples of prior art piston pumps and are incorporated herein by this reference.

BRIEF SUMMARY OF THE INVENTION

Disclosed is a variable flow rate mechanical pump assembly useful in steam appliances and in other systems.

Featured is a mechanical pump comprising a motor with an output shaft, a cam coupled to the output shaft for rotating the cam when the motor is energized, and a driver with spaced ledges engaging the cam and driven linearly by the rotating cam. The piston is driven by the driver. A cylinder receives the piston therein and includes an inlet section for drawing fluid into the cylinder and an outlet section for pumping fluid out of the cylinder as the piston reciprocates in the cylinder.

The pump motor is preferably a synchronous, constant speed motor operable by a line voltage. The pump may further include a spring compressed by the piston. In one version, the piston is directly coupled to the driver. The result is a single speed pump. In another version, the pump is variable speed. There, an adjuster is located between the driver and the piston and is configured to vary the stroke of the piston. The driver may include a race receiving a pin of the piston therein adjustably varying the relationship between the piston and the driver. The adjuster may reside between a ledge of the driver and the piston and the adjuster may include stepped portions each engaging the piston depending on the position of the adjuster. Further included may be an actuator for the adjuster. One actuator includes one or more races receiving one or more tabs of the adjuster. The actuator may include a handle for sliding the actuator.

Also featured is a variable flow rate mechanical pump comprising a motor driving an output shaft, a cam coupled to the output shaft, a piston driver linearly driven by the cam, and an adjuster between the piston driver and the piston configured to vary the stroke of the piston. A variable flow rate device may include a motor, a pump configured with a piston, a piston driver driven by the motor and driving the piston, and an adjuster configured to vary the relationship between the piston and the piston driver. The motor may include an output shaft with a cam coupled thereto driving the piston driver.

Also featured is a steam mop comprising a steam generator providing steam to a mop head, and a pump providing liquid to the steam generator. The pump includes a motor driving an output shaft, a cam coupled to the output shaft for rotating the cam when the motor is energized, a driver with spaced ledges engaging the cam and driven linearly by the rotating cam, a piston driven by the driver, and a cylinder receiving the piston therein including an inlet section for drawing fluid into the cylinder from a reservoir and an outlet section for pumping fluid out of the cylinder to the steam generator as the piston reciprocates in the cylinder.

One steam mop pump assembly includes a piston for pumping a liquid, a motor, a piston driver driven by the motor, and a coupling between the piston and the piston driver configured to adjust the position of piston relative to the piston driver.

The subject invention, however, in other embodiments, need not achieve all these objectives and the claims hereof should not be limited to structures or methods capable of achieving these objectives.

BRIEF DESCRIPTION OF THE FIGURES

Other objects, features and advantages will occur to those skilled in the art from the following description of a preferred embodiment and the accompanying drawings, in which.

DETAILED DESCRIPTION OF THE INVENTION

Figure 1:
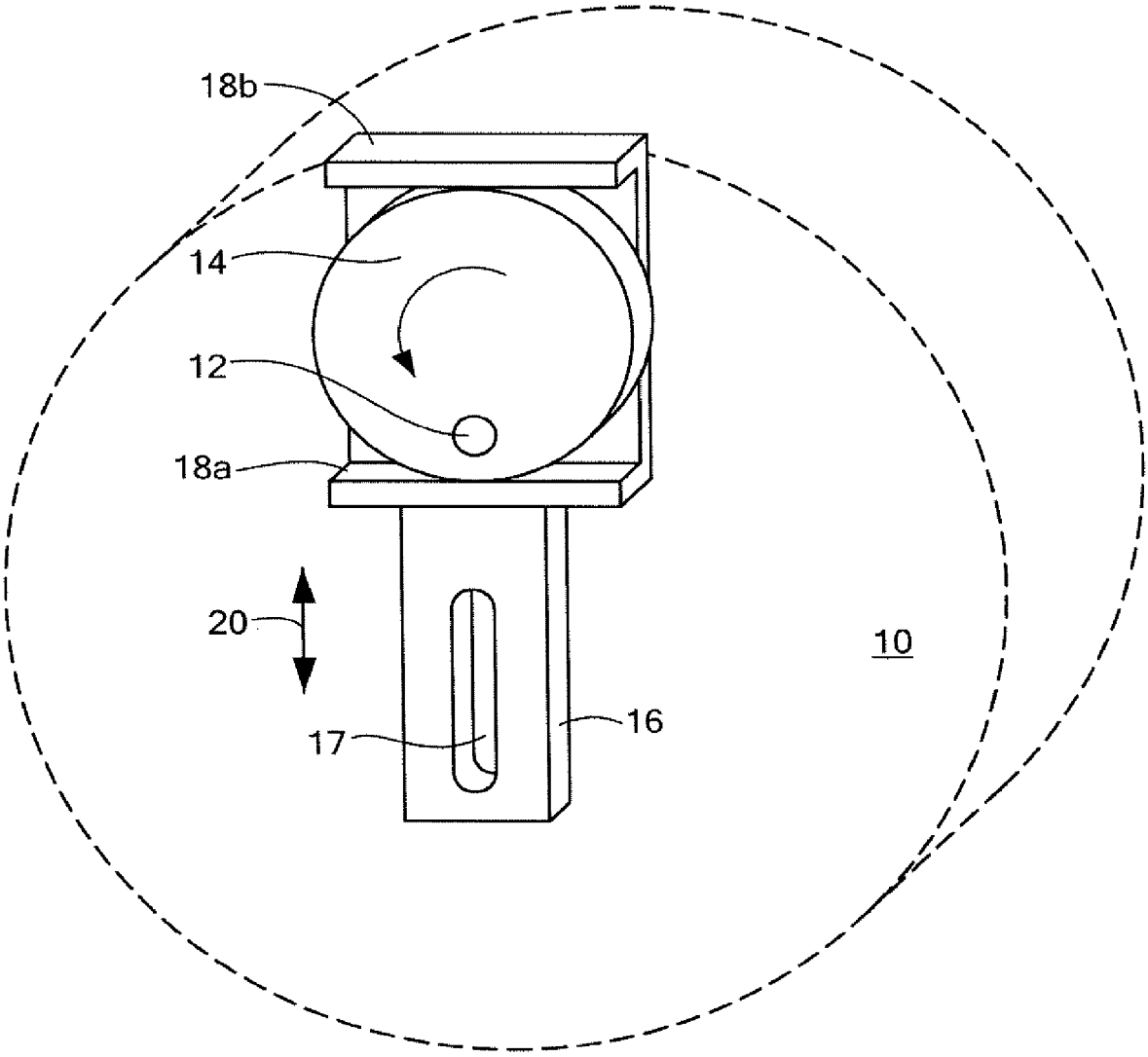
FIG. 1 is a schematic three dimensional front view of a pump piston driver linearly driven by a cam in accordance with one example of the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 3:
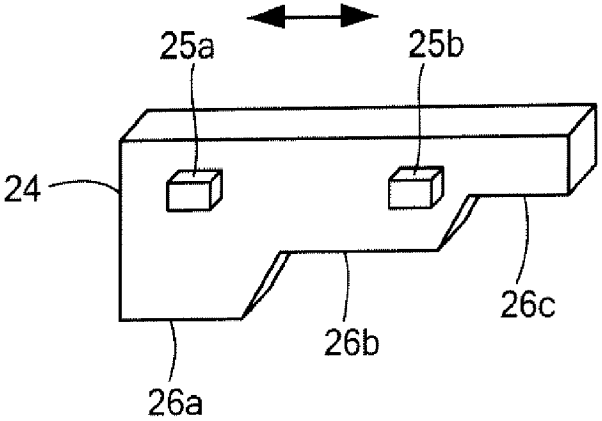
FIG. 3 is a schematic three dimensional front view showing an adjuster component limiting the stroke of the piston shown in FIG. 2.
Figure 2:
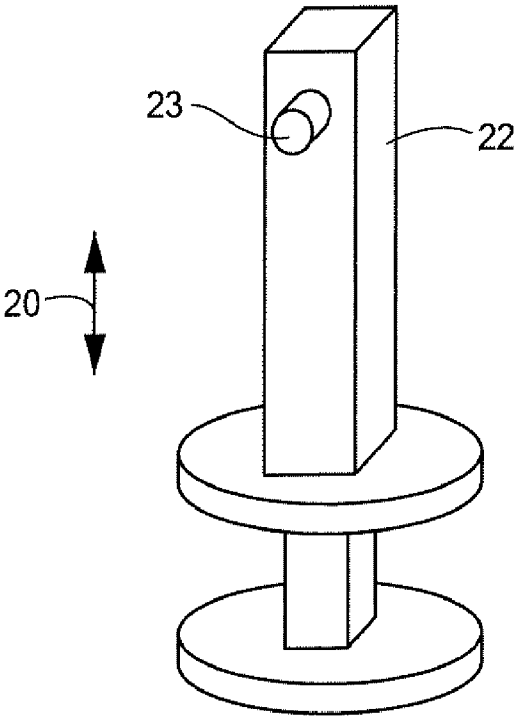
FIG. 2 is a schematic three dimensional rear view of a piston driven by the piston driver of FIG. 1.
Figure 6:
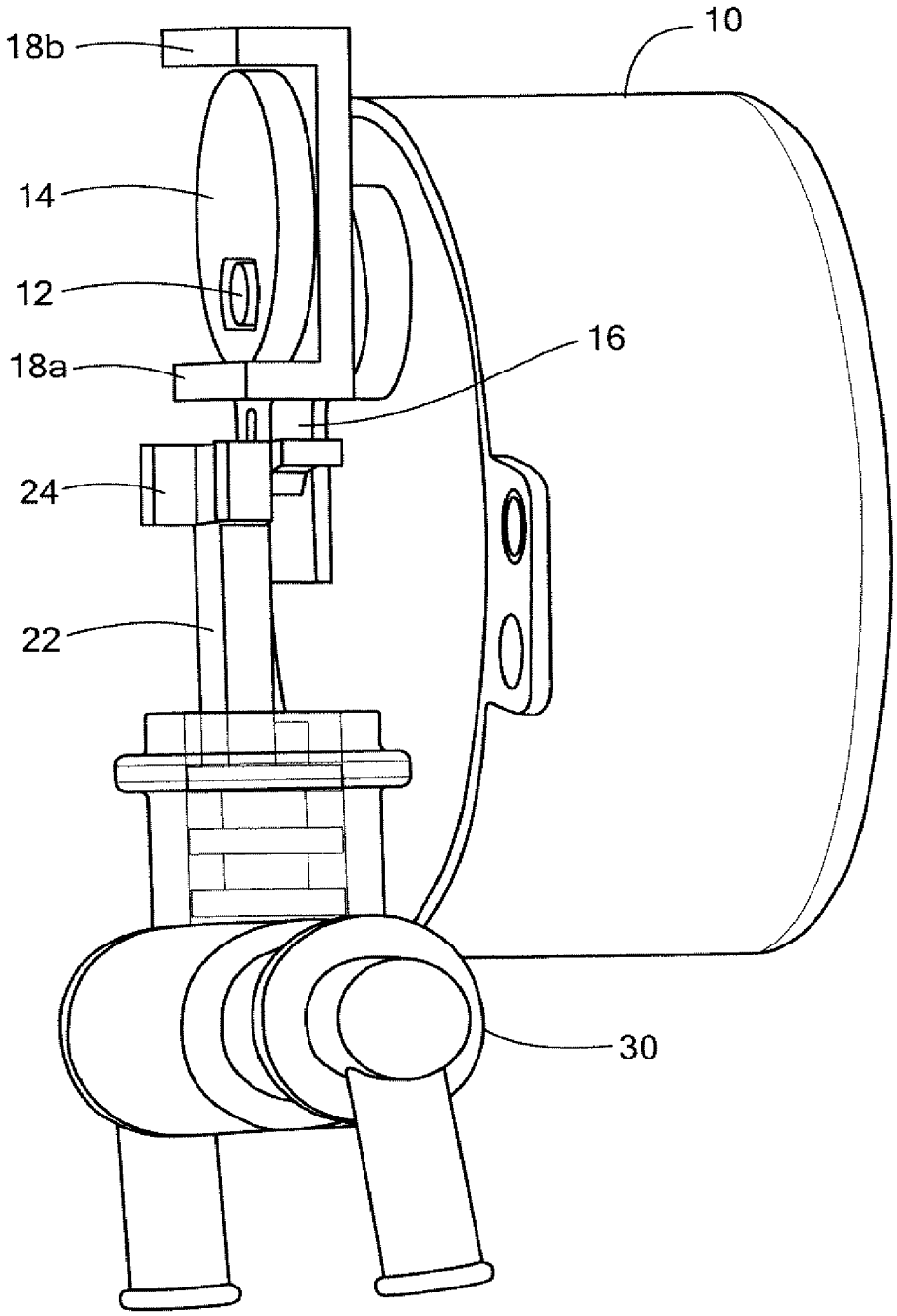
FIG. 6 is another schematic three dimensional view showing the components of FIGS. 1-3 in their assembled configuration.

FIG. 1 shows small 120 VAC synchronous motor 10 (e.g., a constant 60 RPM motor) with a small profile (e.g., 50 mm in dia. and 20 mm deep) driving rotating output shaft 12. Cam 14 is coupled to motor output shaft 12 and drives piston driver 16 linearly in the direction of arrow 20 with ledges 18*a* and 18*b* engaging cam 12. Piston driver 16 drives pump piston 22, FIG. 2 linearly again shown by arrow 20. In some embodiments, the piston 22. FIG. 2 is adjustable with respect to piston driver 16, FIG. 1 to vary the stroke length of the piston. Here, adjuster 24, FIG. 3 is disposed between piston driver 16, FIG. 1 and piston 22, FIG. 2 and is configured with stepped portions 26*a*-26*c* which function to adjust the relationship between driver 16, FIG. 1 and piston 22 to vary the stroke of piston 22, FIG. 2 when pin 23, FIG. 2 resides in race 17, FIG. 1 in piston driver 16. See also FIG. 6.

Figure 5A:
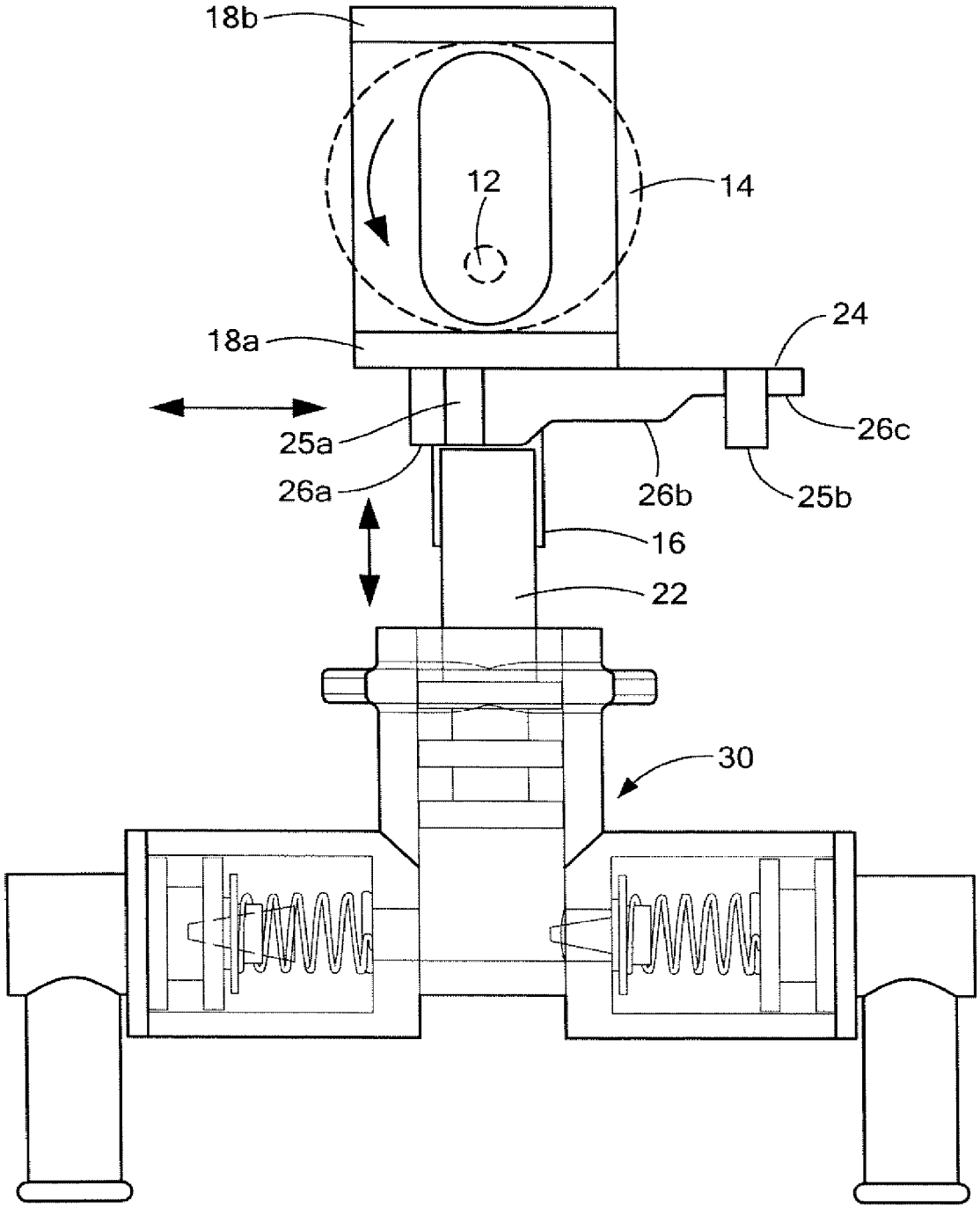
FIG. 5A is a schematic view showing the components of FIGS. 1-3 in their assembled configuration and with the adjuster limiting the piston stroke for a high flow output from the pump.
Figure 5B:
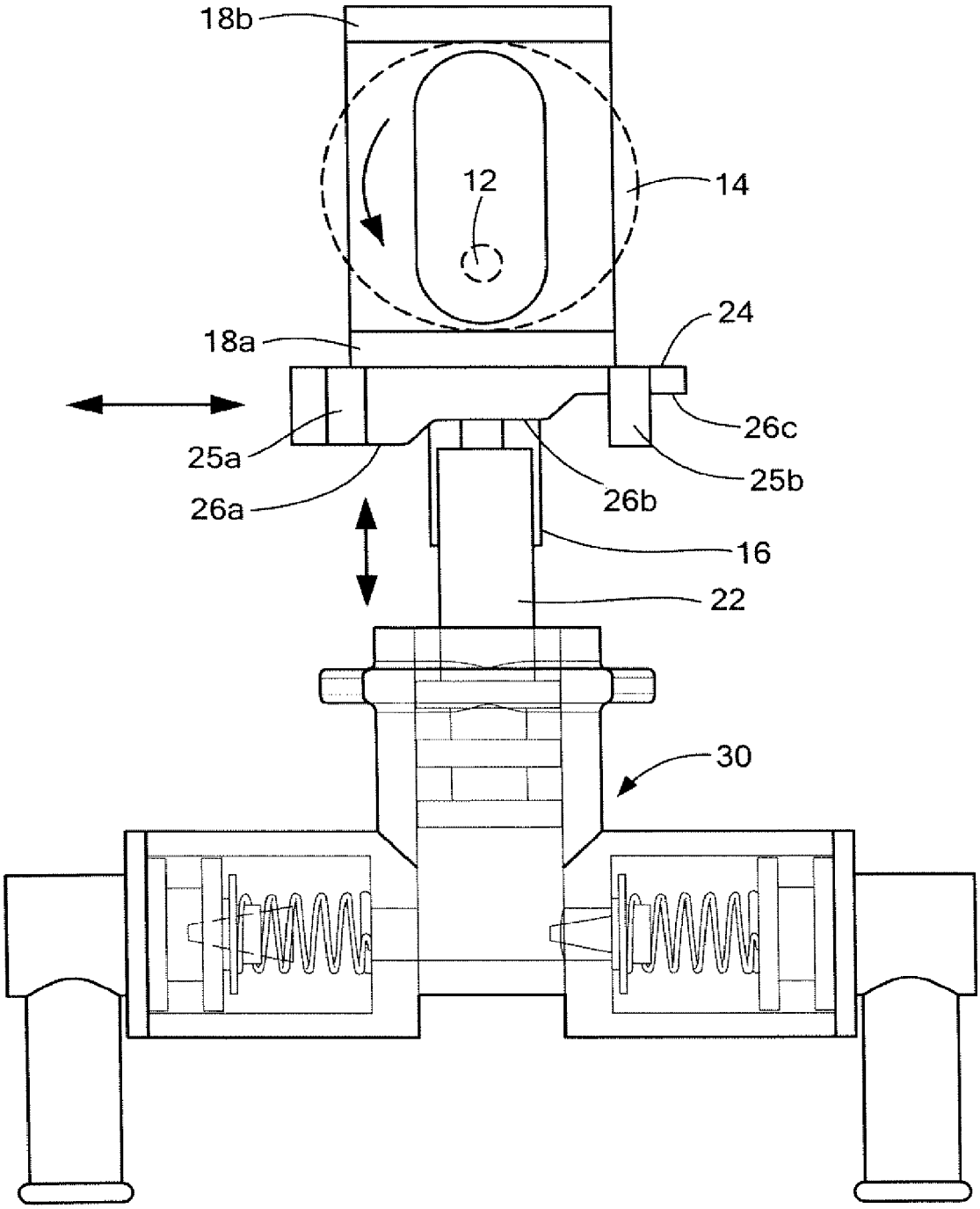
FIG. 5B is a schematic view similar to FIG. 5A except now the adjuster has been slid to the left in the figure for a medium flow rate.
Figure 5C:
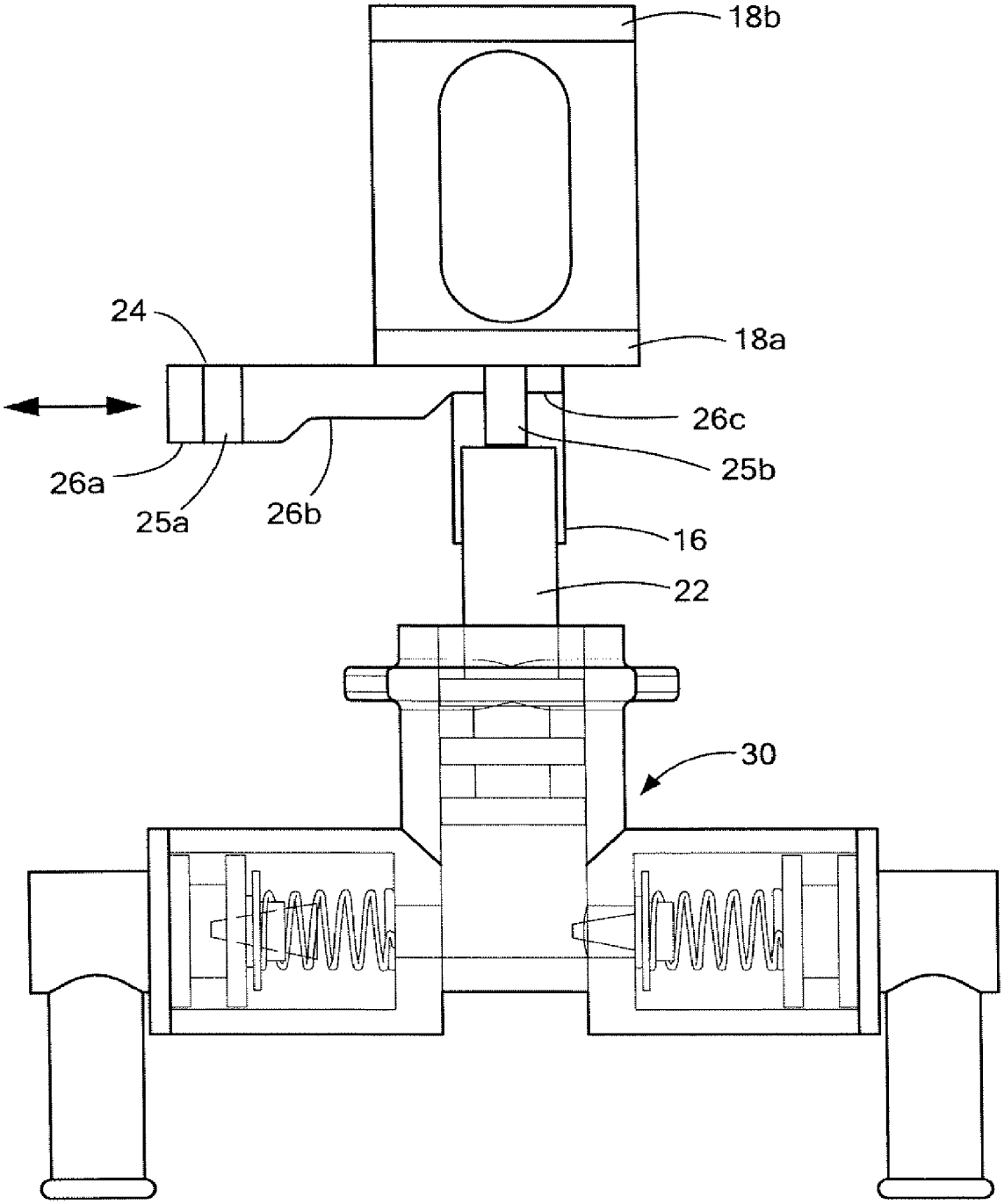
FIG. 5C is a schematic view similar to FIG. 5A and FIG. 5B but now the adjuster has been slid fully to the left in the figure for a low flow rate setting.

In the examples shown in FIGS. 5A-5C, the stroke of piston 22 is varied due to the adjuster being moved. In FIG. 5A the thickest step 26*a* is between the top of piston 22 and the underside of step portion 26*a*. This would correspond to the longest piston stroke and a "high" steam setting for a mop, in one example. In FIG. 5B, the adjuster 24 is slid to the left and now thinner step 26*b* is between the top of piston 22 and the underside of step portion 26*b*. This would correspond to a "medium" steam setting for a mop. In FIG. 5C, adjuster 24 is slid even further to the left and now the thinnest step 26*c* is between the top of piston 22 and the underside of step portion 26*a*. This would correspond to a "low" steam setting for a mop.

Figure 4:
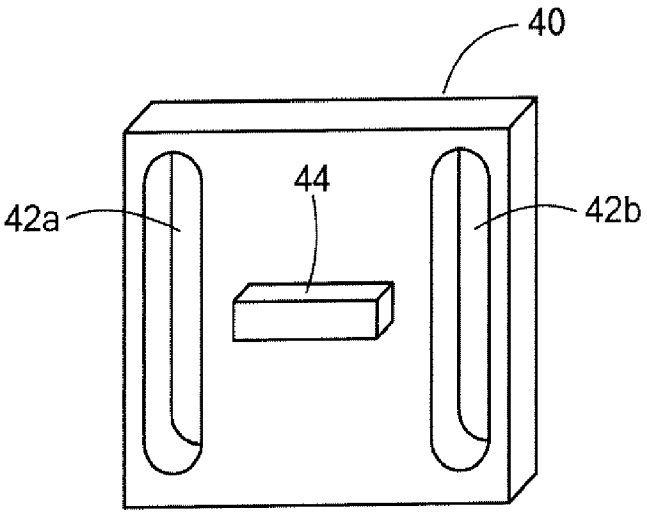
FIG. 4 is a schematic three dimensional front view showing an example of an adjuster actuator.

FIG. 4 shows actuator 40 for the adjuster 24. FIG. 3 with races 42*a* and 42*b* slidably receiving therein tabs 25*a* and 25*b*, FIGS. 3 and 5 of adjuster 24. See also FIG. 7. Actuator 40 may include handle 44 for sliding actuator 40 transversely with respect to the piston driver—an action which drives the adjuster both transversely across and up and down along the axis of the piston driver.

Figure 7:
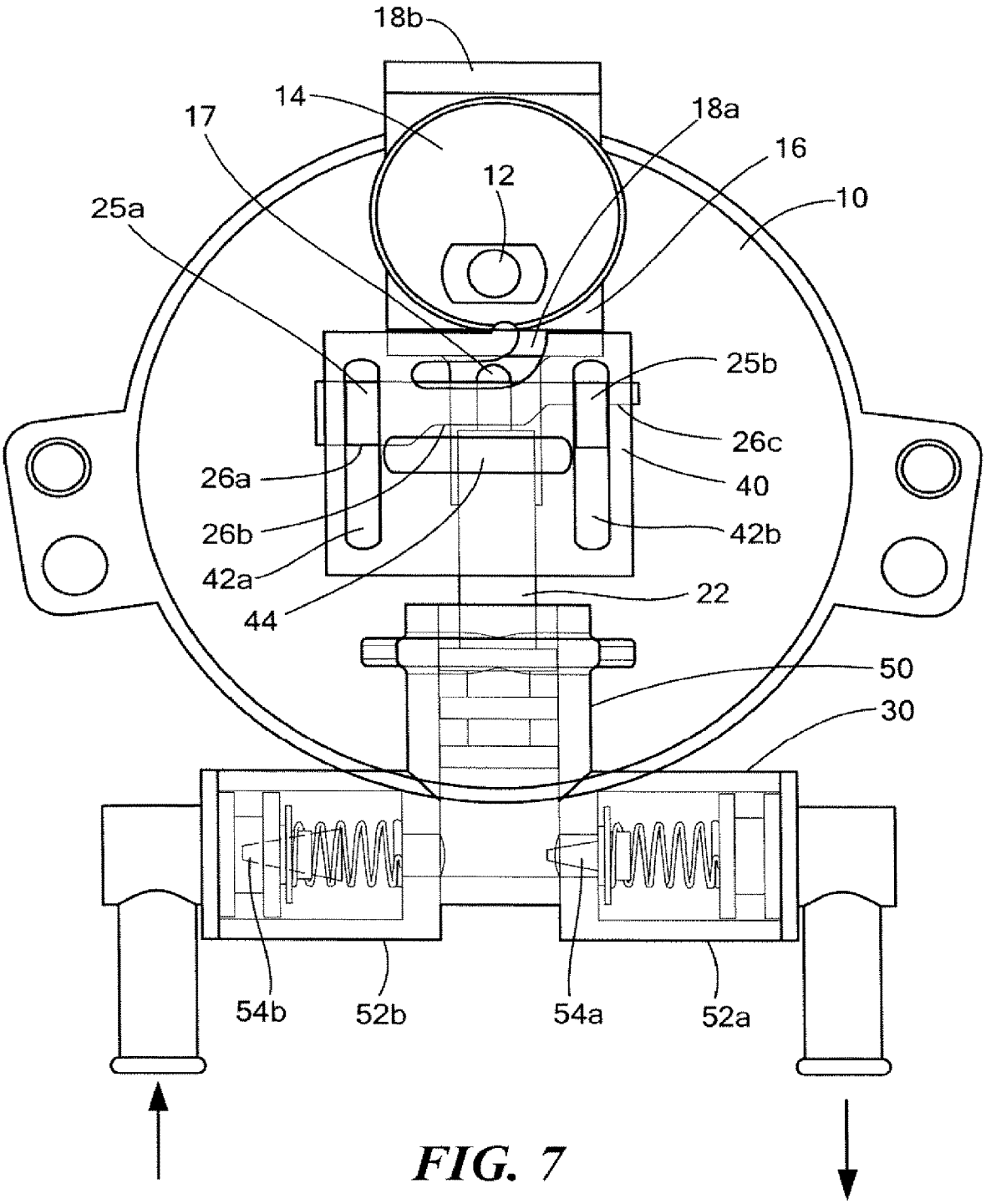
FIG. 7 is a schematic front view showing the addition of the adjuster actuator of FIG. 4 to the assembly.

In FIG. 7, piston 22 typically extends into cylinder 50 which communicates with inlet section 52*b* and outlet section 52*a* each including corresponding check valves 54*a*, 54*b*, respectively. Duck bill or other valves may be used. Driving piston 22 down in cylinder 50 pushes water out outlet section 52*a* as valve 54*a* opens while driving piston up in cylinder 50 creates a vacuum pulling water into cylinder 50 as valve 54*b* opens. Adjuster 24 functions to change the stroke of piston 22 in cylinder 50 and actuator 40 changes the position of adjuster 24.

Figure 8:
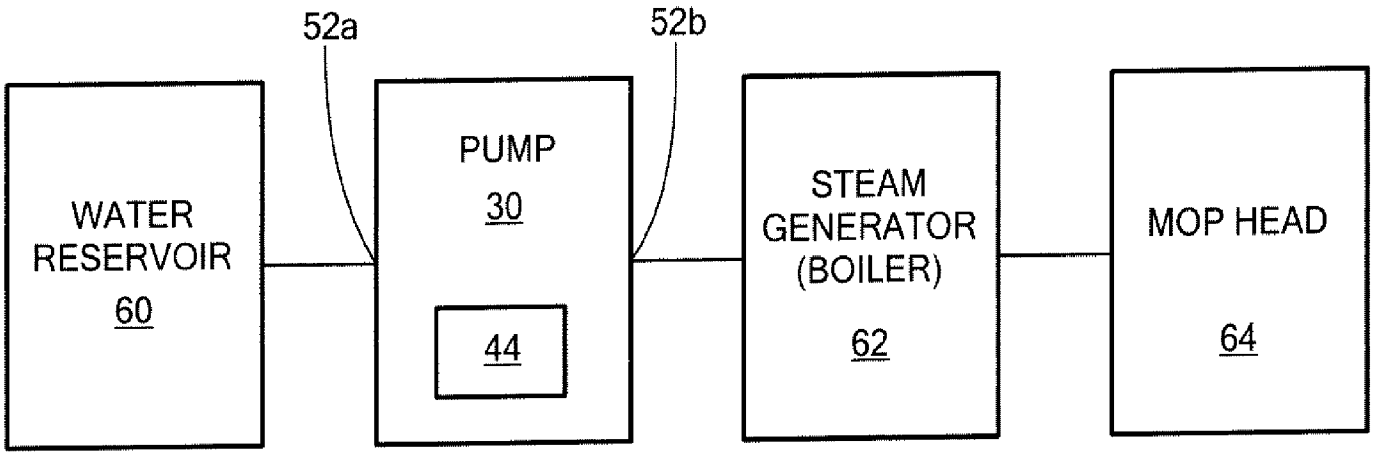
FIG. 8 is a schematic block diagram showing the primary components associated with a typical steam mop in accordance with examples of the invention.
Figure 9:
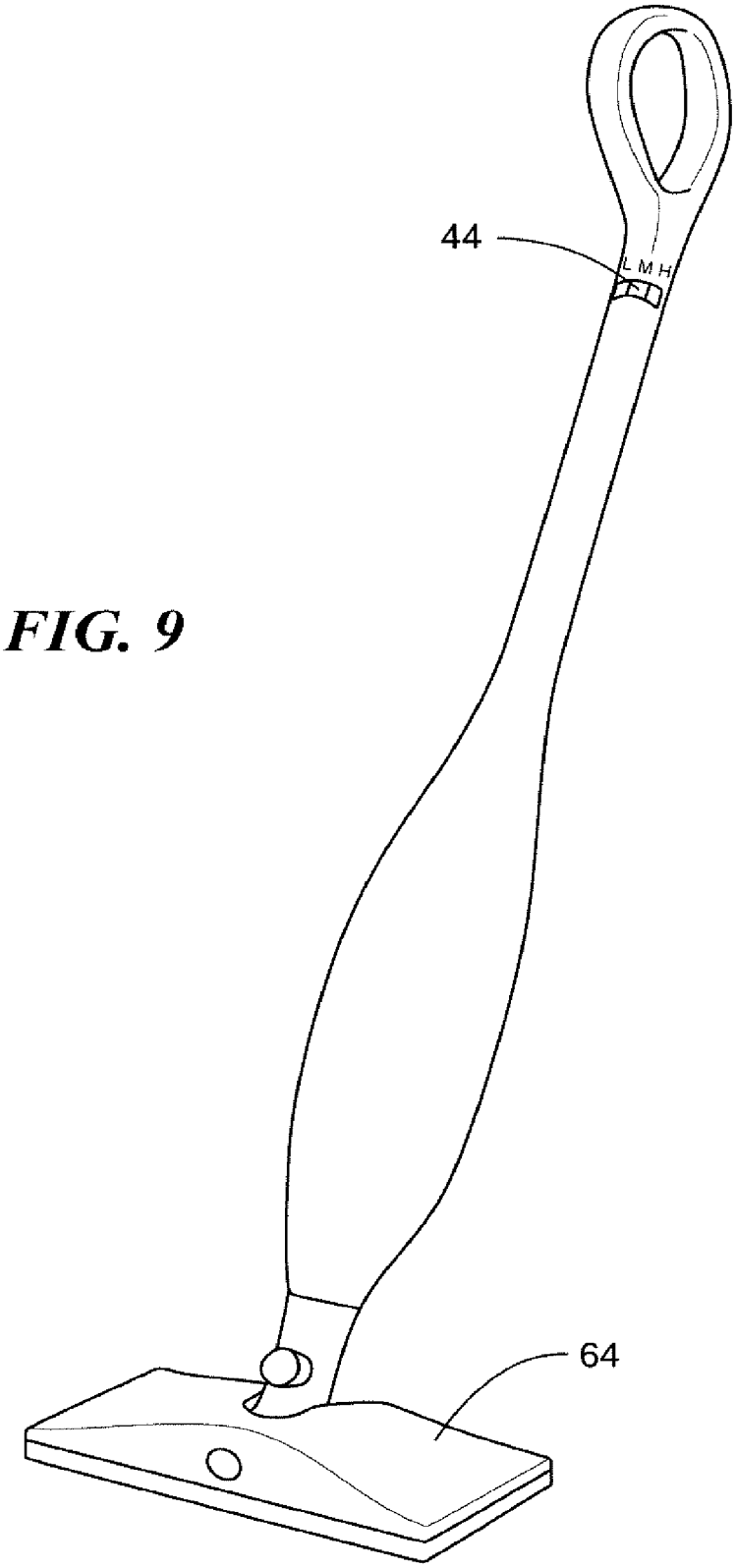
FIG. 9 is a schematic three dimensional front view of an example of a steam mop incorporating the pump described herein.
Figure 10B:
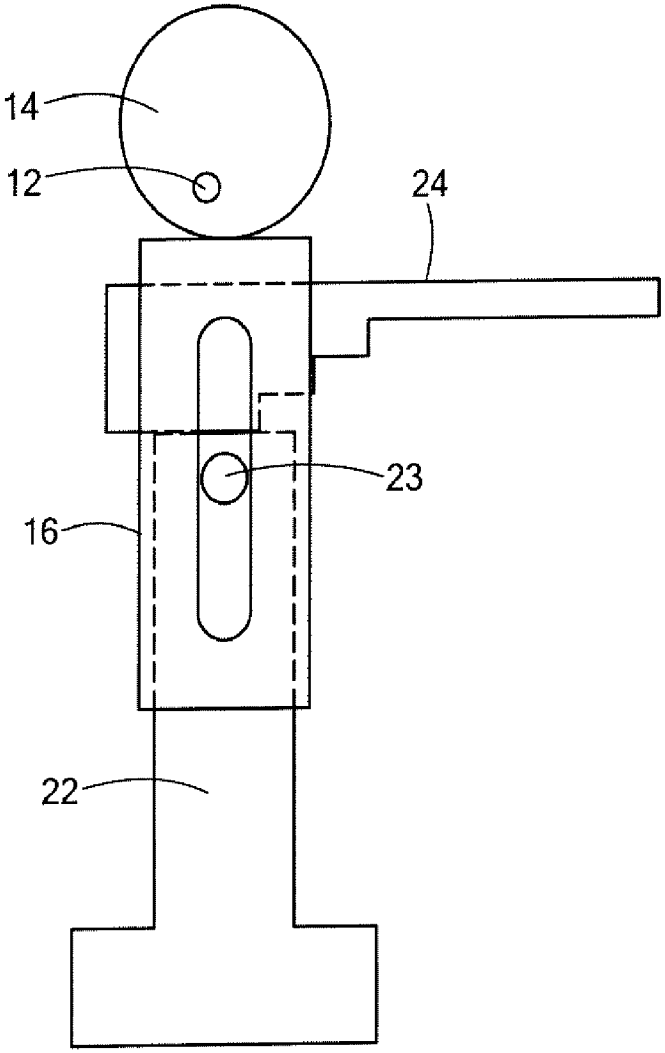
FIGS. 10A and 10B are views showing the adjustable nature of the piston relative to the piston driver.
Figure 10A:
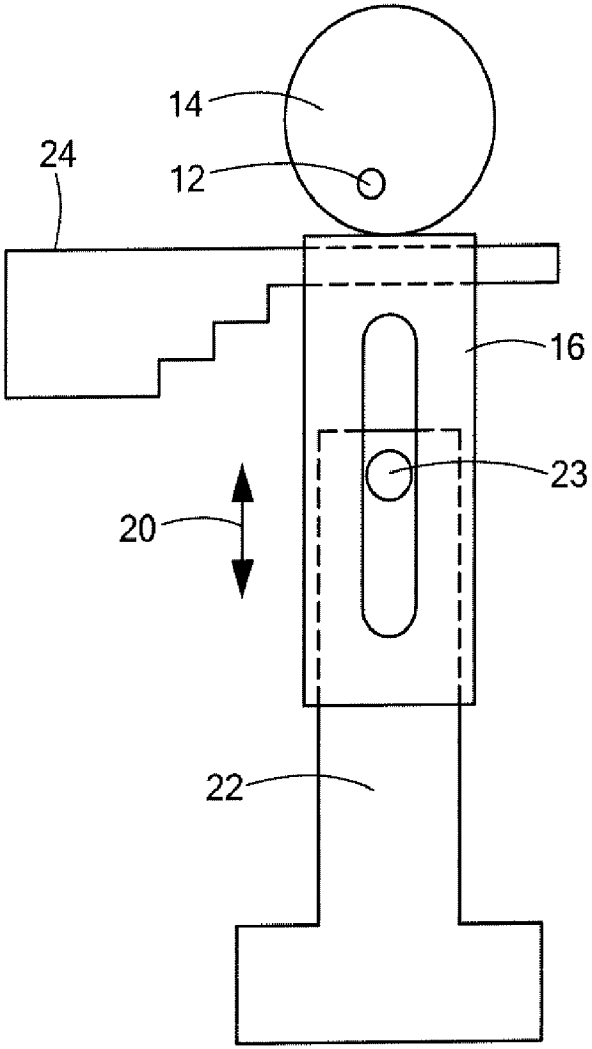

In a steam mop configuration, a water reservoir 60, FIG. 8 is connected to pump 30 inlet section 52*b* and the pump assembly includes an adjuster actuator handle 44. The pump outlet section 52*b* is connected to the steam generator or boiler 62 which produces steam delivered mop head 64. The user can slide adjuster actuator handle 44 right and left as shown, for example, in FIG. 9 for low, medium, and high steam settings if the pump assembly 30, FIG. 8 is disposed in the upper portion of the steam mop handle. In other configurations, other means can be used to manipulate either the actuator handle or the adjuster of FIG. 3 directly including mechanical linkages, and the like. Further, the adjuster is not limited to three settings. There could be less or more settings and one setting could actually fully limit any travel of the piston resulting in an "off" configuration for the pump even though the pump motor continues to rotate shaft 12 and cam 14, FIG. 1. For example, FIG. 10A shows how piston 22 would remain stationary as driver 16 reciprocates up and down. Thus, with proper sizing of the slot or race 17 and adjuster 24, the pump can be off even if the motor keeps rotating eliminating the need for an electric on/off switch thus reducing production costs. In FIG. 10B, adjuster 24 constrains piston 22 to move with driver 16.

Figure 11A:
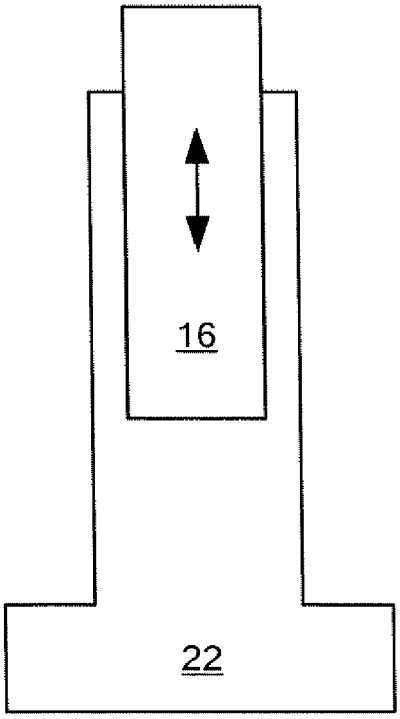
FIGS. 11A-11B show adjustment of a piston relative to the piston driver.
Figure 11B:
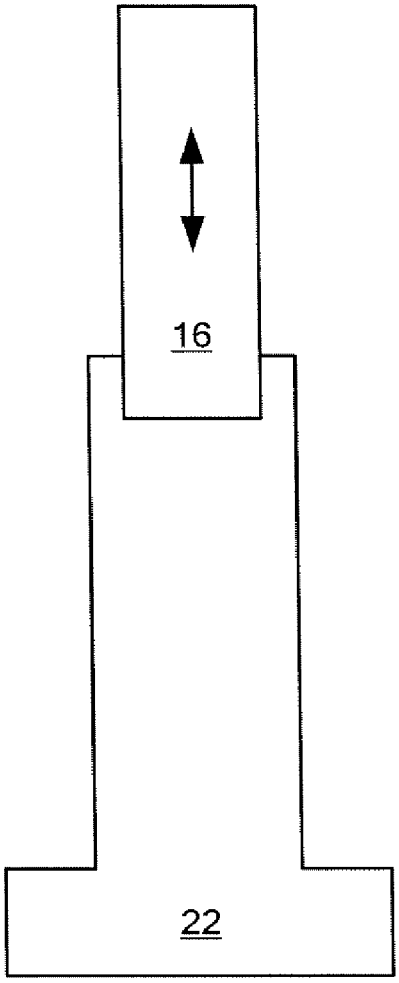

FIGS. 11A-11B show how by adjusting the position of piston 22 relative to driver 16, the stroke length of piston 22 is varied. In FIG. 11A, piston 22 has a short stroke length for a given stroke length of driver 16. In FIG. 11B, piston 22 has a longer stroke length for the same stroke length of driver 16. Conceptually, the length of the piston rod is adjustable.

One result is a variable flow rate mechanical pump preferably employing a constant RPM simple, small, reliable, and long life motor and the ability to control the flow rate of the pump mechanically thus eliminating expensive electronic circuitry and or voltage conversion circuitry.

Figure 12:
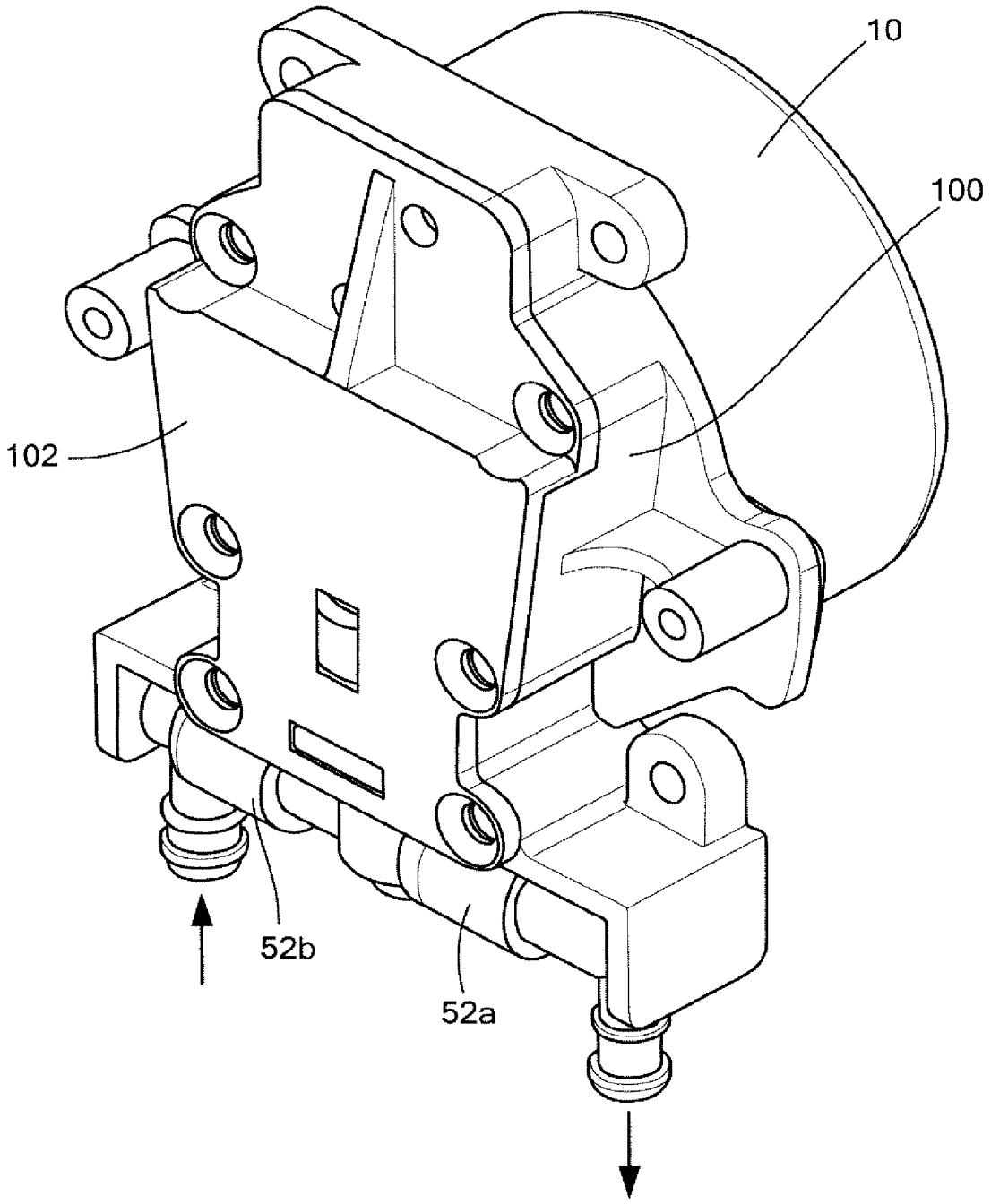
FIG. 12 shows another version of a pump in accordance with the subject invention.
Figure 13:
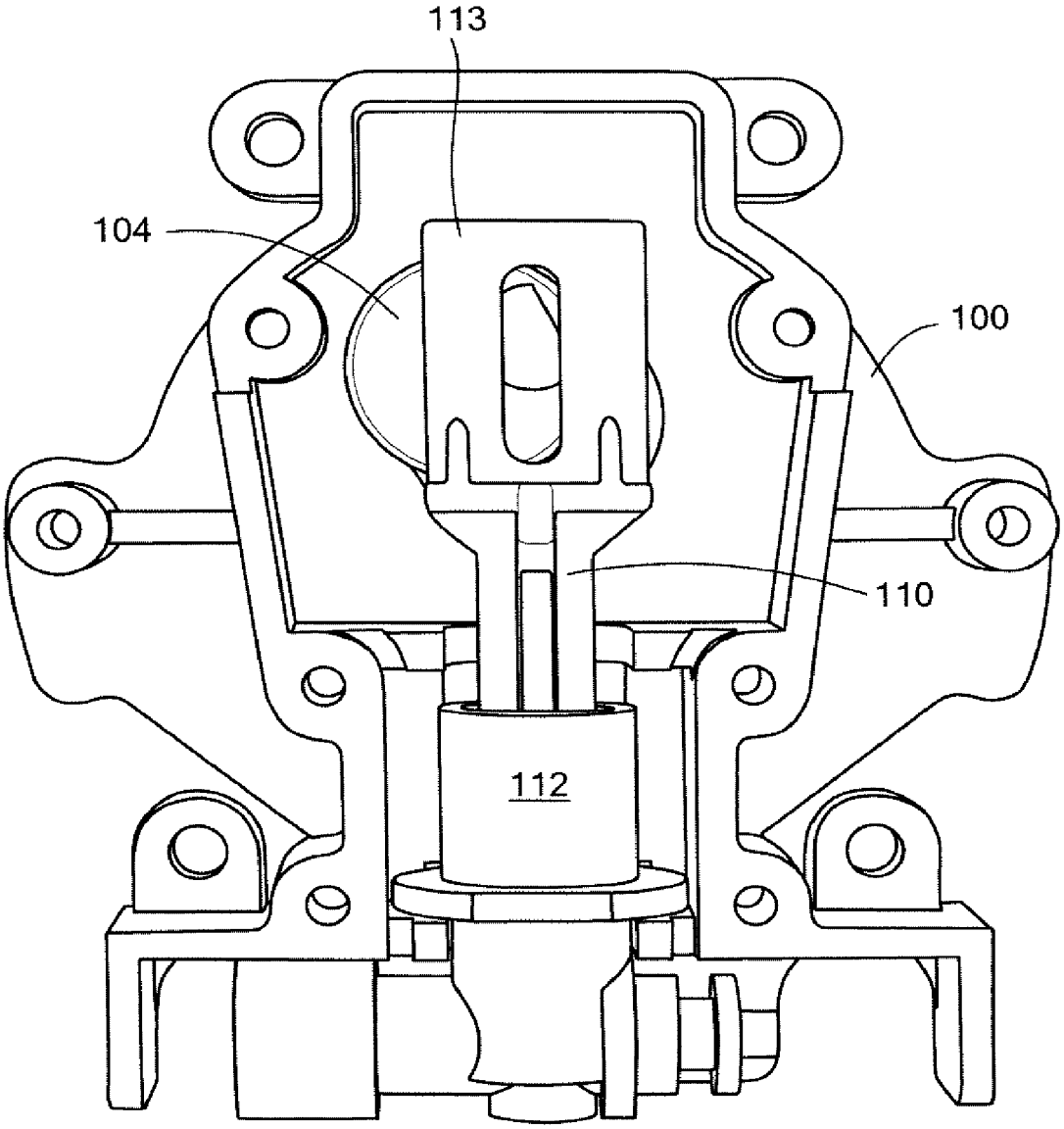
FIG. 13 shows the piston and cylinder subsystems of the pump of FIG. 12.
Figure 14:
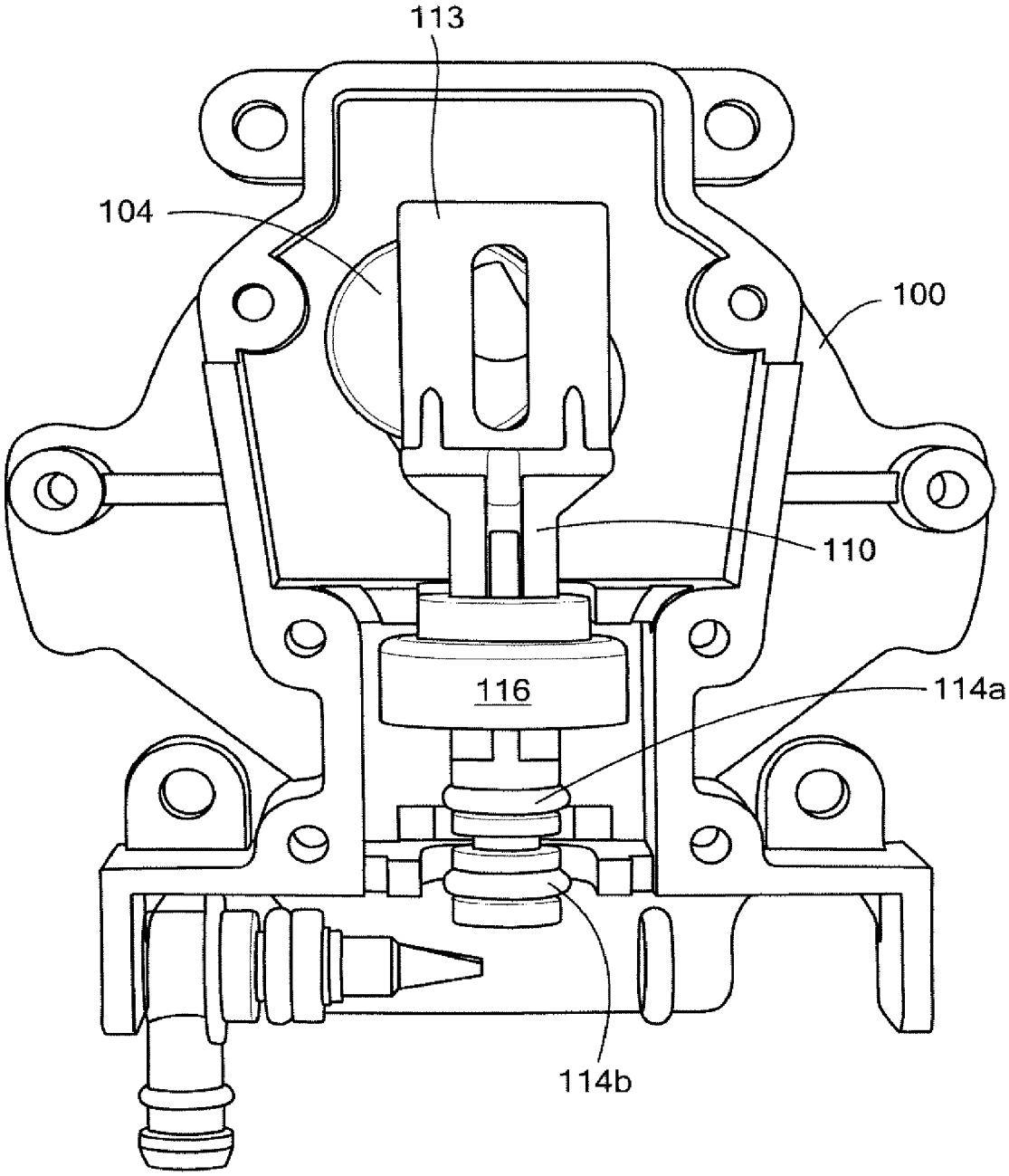
FIG. 14 is another schematic view showing the piston assembly.
Figure 15:
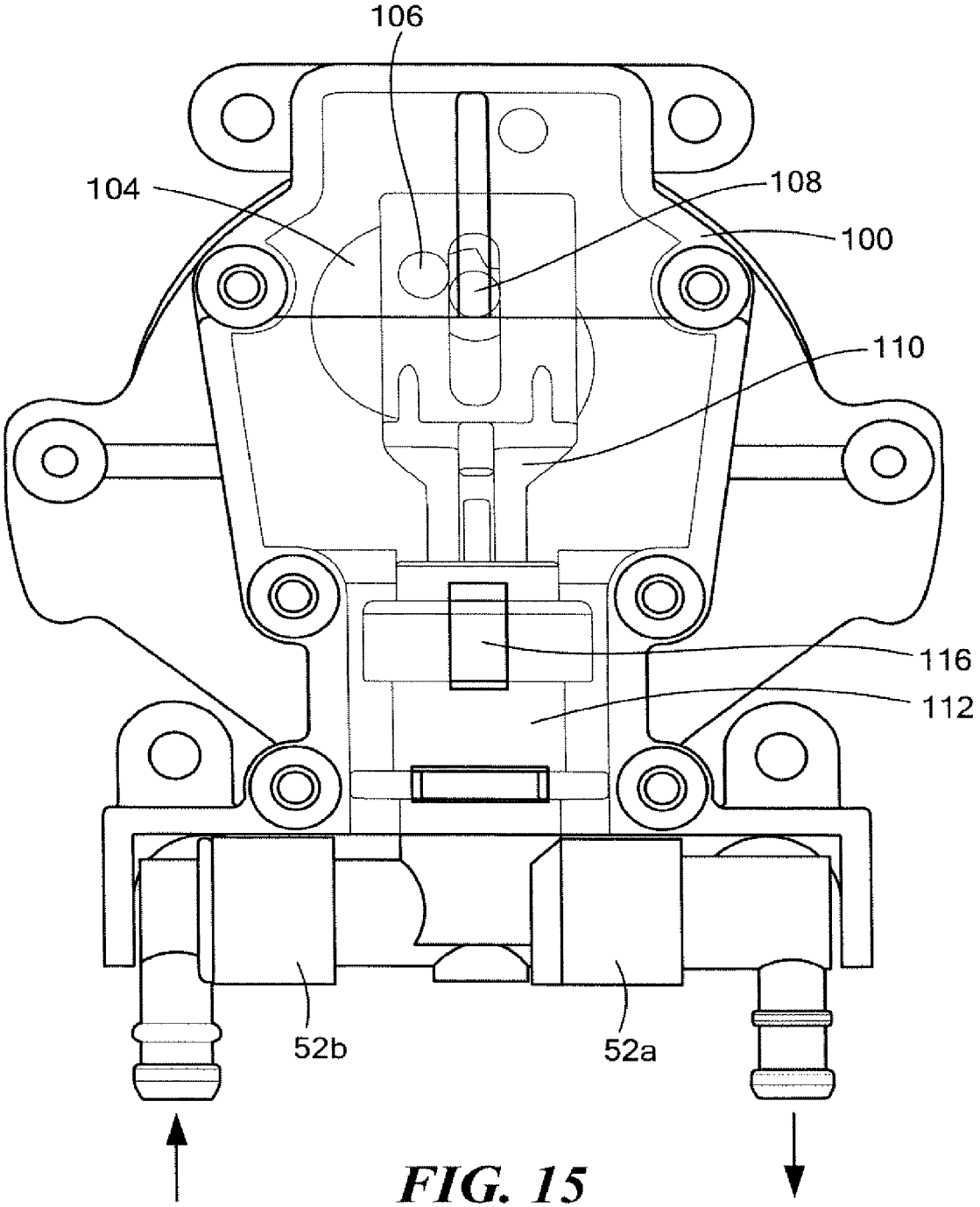
FIG. 15 is a schematic view of the interior components of the pump of FIG. 12.
Figure 16:
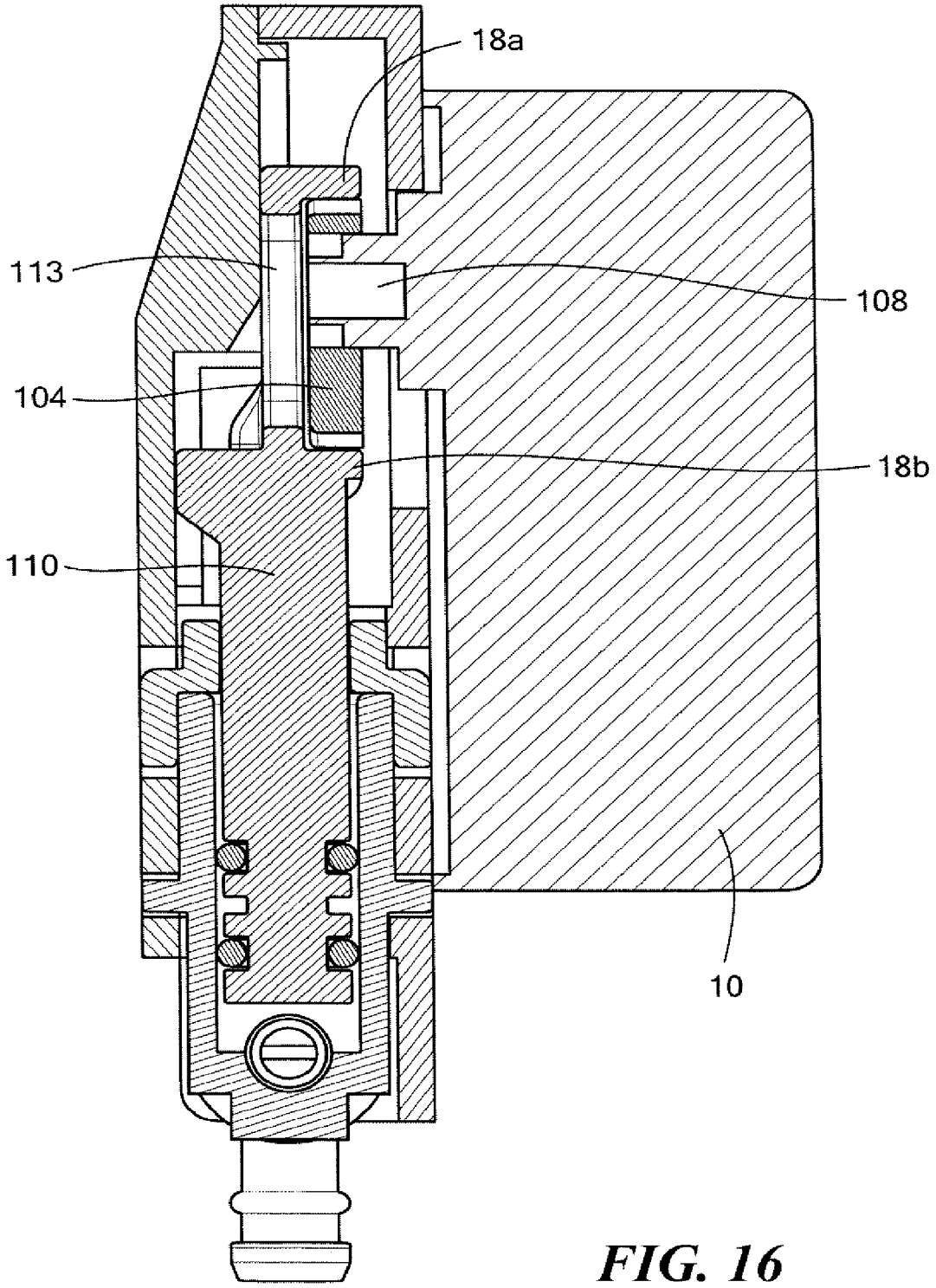
FIG. 16 is a schematic side view showing the pump motor and piston assembly.
Figure 17:
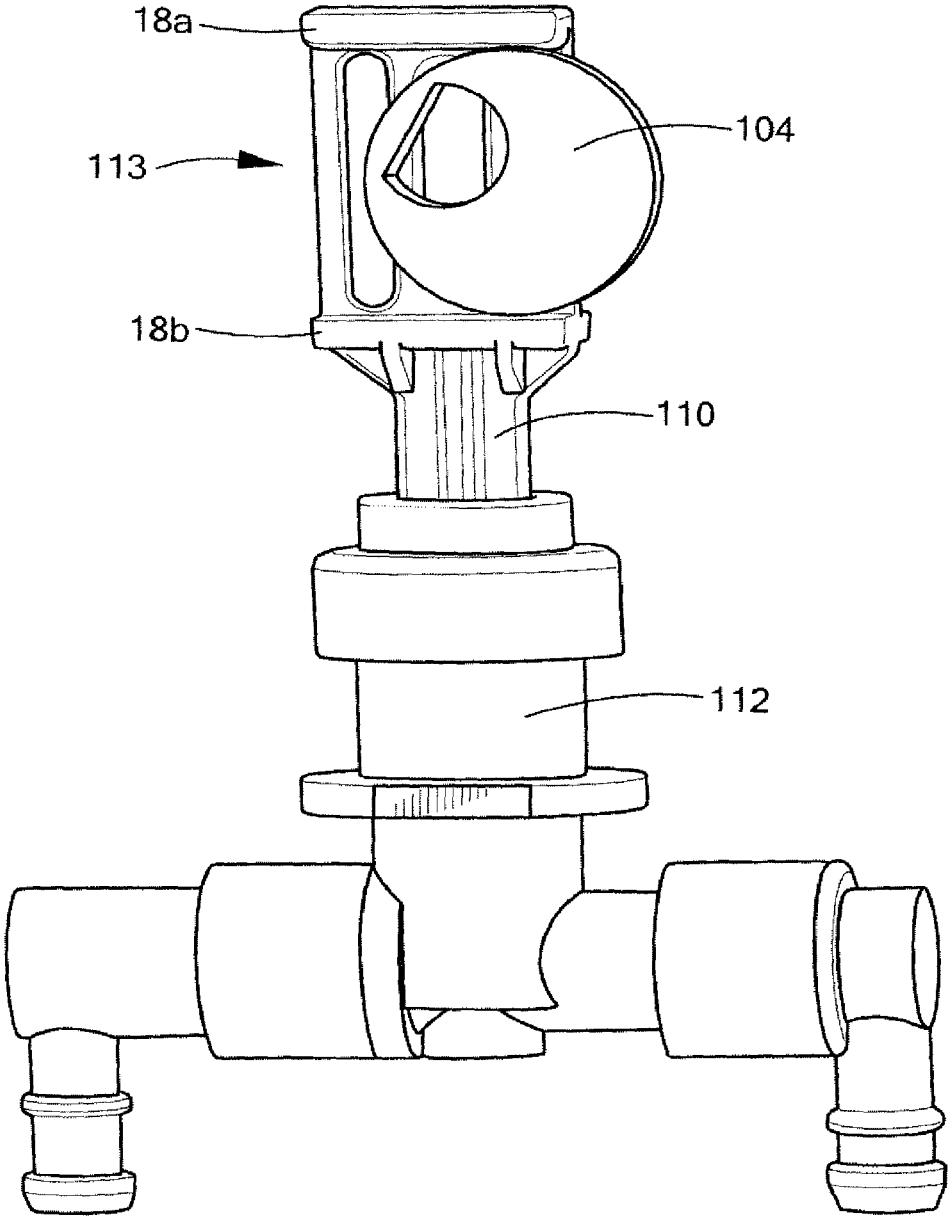
FIG. 17 is a schematic view showing the piston and cylinder arrangement.

FIG. 12 shows another design for a single speed pump 100 incorporating 120 VAC synchronous motor 10 which is preferably powered by line voltage. No transformer or transformer related circuitry is required, saving manufacturing costs. Pump 100 has base plate 100 and cover plate 102. Motor 10 is coupled to base plate 100 and cam 104, FIGS. 13-15 which is eccentrically coupled to output shaft 108 of the motor. Cam 104 drives piston 110 up and down in cylinder 112 via piston driver 113 ledges 18*a*, 18*b*, FIGS. 16-17 as discussed above with respect to FIG. 1. Piston 110 may include spaced O-rings 114A and 114B. FIG. 14 sealing against the inside of cylinder 112, FIG. 15. Cylinder cover 116 may also be provided to seal piston 110 with respect to cylinder 112. When cam 104 drives piston 110 upwards, FIG. 15, fluid is drawn into inlet section 52*b*. When cam 104 drives piston 110 downwards, fluid is pumped out of outlet section 52*a*. The inlet and outlet sections may include valves as discussed above with respect to FIG. 7.

Figure 18:
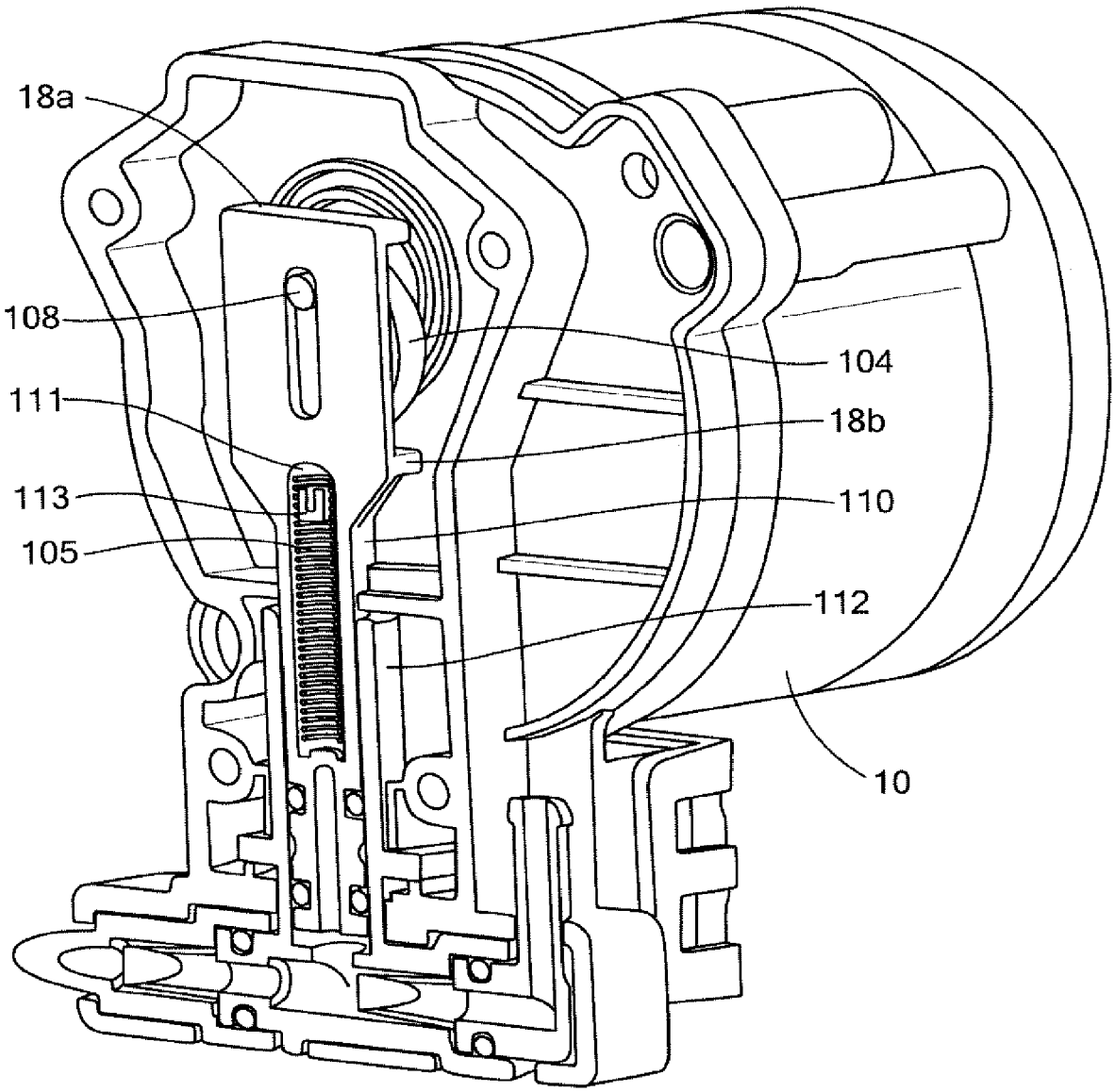
FIG. 18 is a schematic view showing another pump arrangement.

In FIG. 18, a spring 105 is disposed inside piston 110 aperture 11 to store energy. Housing 110 includes spring stop 113 extending into piston aperture 111. Spring 105 is compressed on the up stroke of piston 110. Spring 105 equalizes the force required in the pull and push strokes and increases the pump torque significantly (e.g., by 20%). A similar spring arrangement may be used in the variable stroke designs of FIGS. 1-11.

Specific features of the invention are shown in some drawings and not in others, but this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A mechanical pump comprising:

a motor with an output shaft;

a driver and a piston driven by the driver;

a cylinder receiving the piston therein including an inlet section for drawing fluid into the cylinder and an outlet section for pumping fluid out of the cylinder as the piston reciprocates in the cylinder; and an adjuster disposed between the driver and the piston and configured to vary a stroke length of the piston within the cylinder, the adjuster including a plurality of stepped portions configured to move transversely with respect to the piston driver to select each one of the plurality of stepped portions is configured to individually be aligned between the driver and the piston at a transverse position of the adjuster relative to the piston, and the transverse position of each one of the plurality of stepped portions corresponds to a different stroke length, wherein linear movement of the driver causes linear movement of the adjuster, the linear movement of the adjuster being parallel to a longitudinal axis of the driver.

2. The pump of claim 1 in which the motor is a synchronous constant speed motor operable by a line voltage.

3. The pump of claim 1 further including a spring compressed by the piston.

4. The pump of claim 1 in which the piston is directly coupled to the driver.

5. The pump of claim 1 in which the driver includes a race receiving a pin of the piston therein adjustably varying a relationship between the piston and the driver.

6. The pump of claim 1 in which the adjuster resides between a ledge of the driver and the piston.

7. The pump of claim 1 further including an actuator for the adjuster.

8. The pump of claim 7 in which the actuator includes one or more races receiving one or more tabs of the adjuster.

9. The pump of claim 7 in which the actuator includes a handle for sliding the actuator.

10. A variable flow rate mechanical pump comprising:

a piston driver;

a piston driven by the driver; and an adjuster disposed between the piston driver and the piston and including a plurality of stepped portions, wherein the adjuster is configured to move transversely with respect to the piston driver to a plurality of transverse positions in which each one of the plurality of stepped portions is aligned between the piston driver and the piston, each of the plurality of transverse positions corresponding to a different stroke length of the piston, wherein linear movement of the piston driver causes linear movement of the adjuster, the linear movement of the adjuster being parallel to a longitudinal axis of the piston driver.

11. A variable flow rate device comprising:

a pump comprising with a piston;

a piston driver configured to drive the piston; and an adjuster configured to vary a relationship between the piston and the piston driver to vary a stroke length of the piston within the pump, the adjuster including a plurality of stepped portions, wherein each one of the plurality of stepped portions is configured to be disposed between the driver and the piston depending on a lateral position of the adjuster relative to the piston, and alignment of each one of the plurality of stepped portions with the driver and the piston corresponds to a different stroke length, wherein linear movement of the piston driver causes linear movement of the adjuster, the linear movement of the adjuster being parallel to a longitudinal axis of the piston driver.

12. The device of claim 11 in which the motor includes an output shaft with a cam coupled thereto driving the piston driver.

13. A steam mop comprising:

a steam generator providing steam to a mop head; and the mechanical pump of claim 1, wherein the mechanical pump is configured to provide liquid to the steam generator.

* * * * *